United States Patent [19]

Brown, deceased

[11] 4,226,447

[45] Oct. 7, 1980

[54] SWIVEL APPARATUS

[75] Inventor: Cicero C. Brown, deceased, late of Houston, Tex., by Joe R. Brown, executor

[73] Assignee: Brown Oil Tools, Inc., Houston, Tex.

[21] Appl. No.: 647,759

[22] Filed: Jan. 9, 1976

[51] Int. Cl.[3] ..... F16L 37/18; B25D 17/14

[52] U.S. Cl. ..... 285/316; 173/57; 285/18

[58] Field of Search ..... 173/57; 285/360, 361, 285/362, 376, 377, 164, 165, 323, 313–316, 38, 81; 175/85

[56] References Cited

U.S. PATENT DOCUMENTS

| | | | |
|---|---|---|---|
| 1,815,660 | 7/1931 | Walker | 285/315 |
| 1,827,257 | 10/1931 | Parker | 285/315 |
| 2,016,066 | 10/1935 | Bannister | 285/164 |
| 2,565,572 | 8/1951 | Pangborn | 285/316 X |
| 2,962,096 | 11/1960 | Knox | 285/315 X |
| 3,188,123 | 6/1965 | Hansen | 285/362 |
| 3,222,088 | 12/1965 | Haeber | 285/316 X |
| 3,282,357 | 11/1966 | Bunn | 175/122 |
| 3,338,596 | 8/1967 | Knox | 285/315 X |
| 3,510,153 | 5/1970 | Newton | 285/315 X |
| 3,655,225 | 4/1972 | Major | 285/316 X |
| 3,722,603 | 3/1973 | Brown | 173/149 |
| 3,779,587 | 12/1973 | Racine | 285/323 |
| 3,828,943 | 8/1974 | Simon | 175/85 |
| 3,888,318 | 6/1975 | Brown | 285/362 |
| 3,949,883 | 4/1976 | Crooke et al. | 175/85 |
| 3,964,771 | 6/1976 | Baudouin | 285/315 |

FOREIGN PATENT DOCUMENTS

| | | | |
|---|---|---|---|
| 601742 | 7/1960 | Canada | 285/165 |

*Primary Examiner*—Lawrence J. Staab

*Attorney, Agent, or Firm*—Browning, Bushman & Zamecki

[57] ABSTRACT

Swivel apparatus suspended for handling pipe joints to be added to or taken from a drill string including powered apparatus connected to a cable for raising and lowering the swivel apparatus. The swivel apparatus may comprise an upper stationary section and a lower rotatable tubular section adapted to receive one end of a pipe joint and having a radially movable latch assembly for engagement therewith. The lower section may be provided with cam apparatus movable, relative to the latch assembly, from an inoperative position to an operative position camming the latch assembly from a first position, permitting free entry of the pipe joint end into the lower section, to a second, latching the pipe joint end in the lower section.

11 Claims, 22 Drawing Figures

Fig. 1
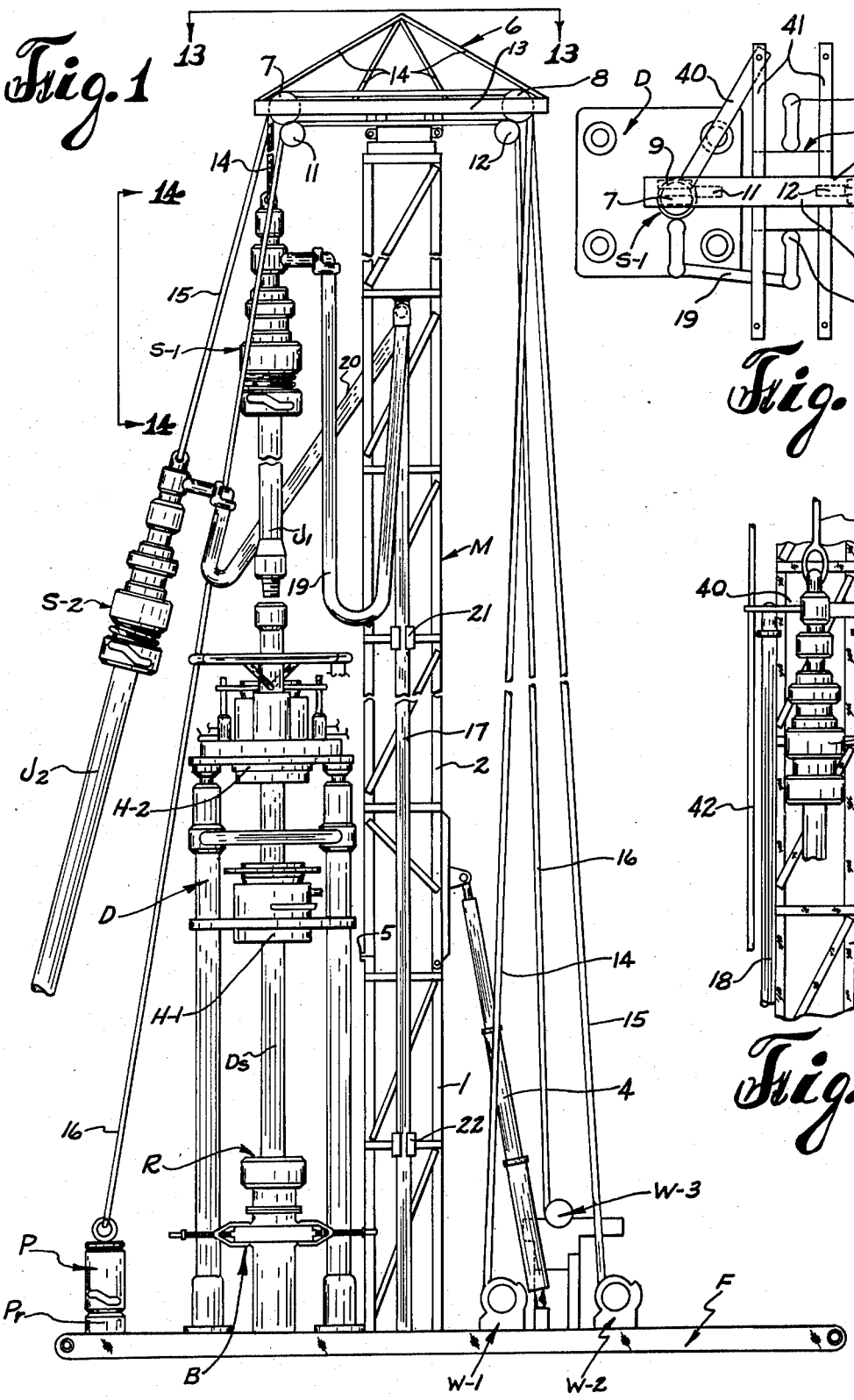
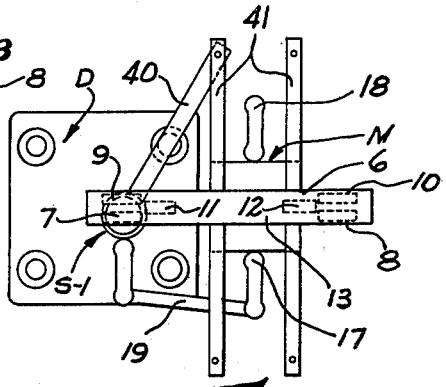
Fig. 13
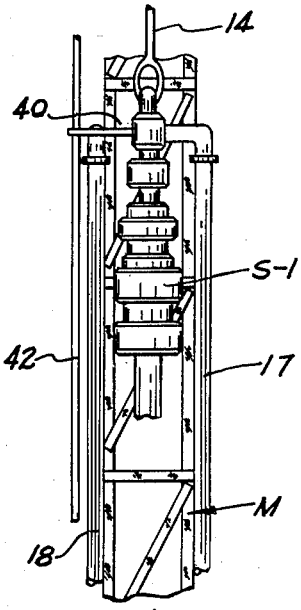
Fig. 14

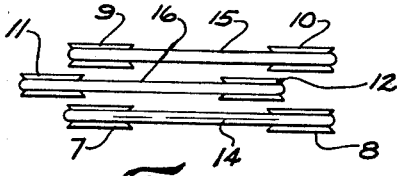
Fig. 8
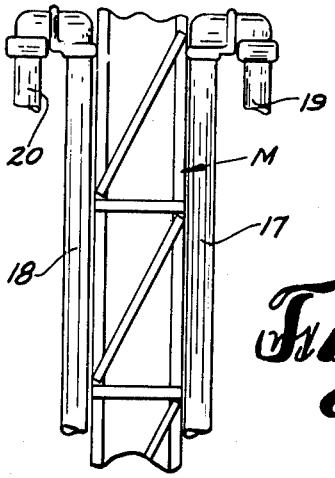
Fig. 9
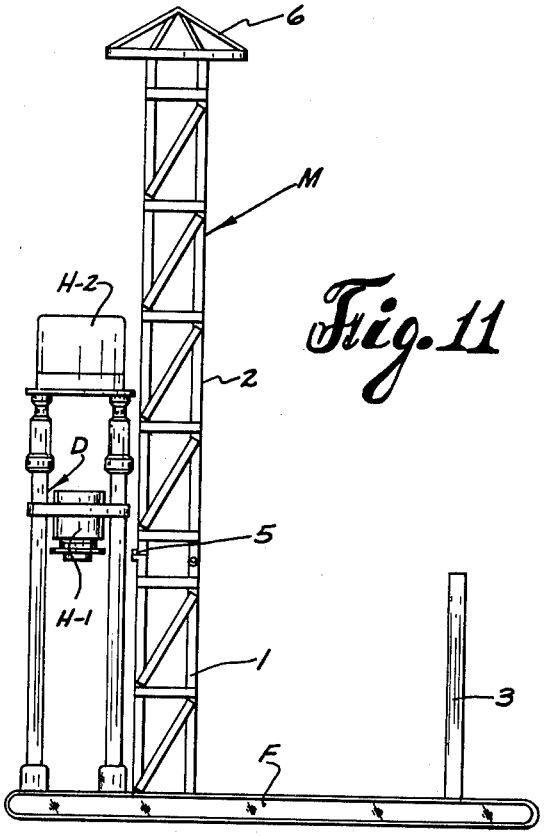
Fig. 11
Fig. 10
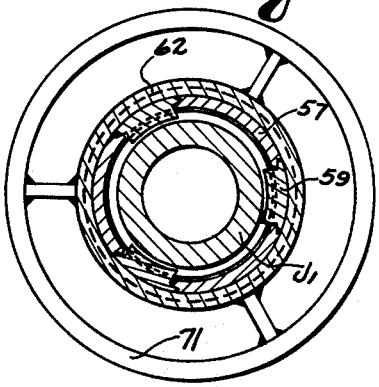
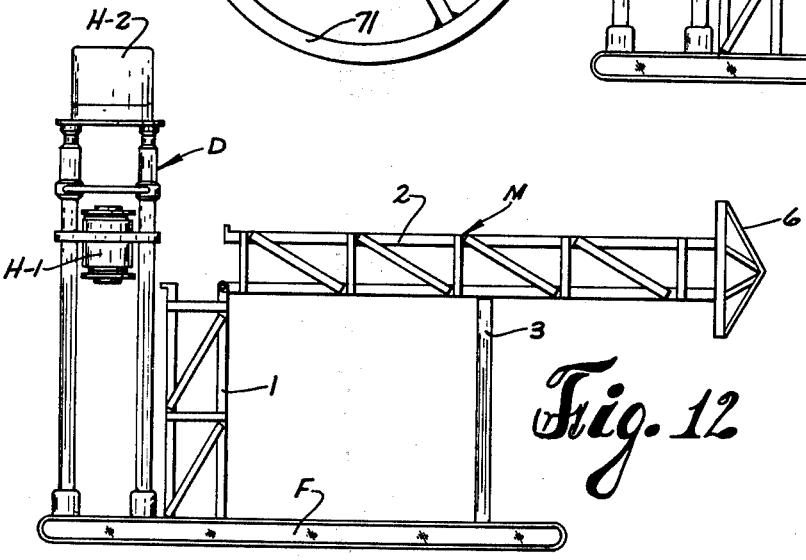
Fig. 12

SWIVEL APPARATUS

BACKGROUND OF THE INVENTION

1. Field of the Invention

The present invention pertains to apparatus for drilling oil and/or gas wells. In particular, it concerns portable well drilling units and special swivel apparatus designed therefor.

2. Description of the Prior Art

In conventional rotary drilling, a power driven rotary table operating through a so-called "Kelly joint" connected to the upper end of the drill pipe string is employed for rotating the drill string. High-powered drawwork systems, including derricks with multiple-strand, cable-connected crown and traveling blocks, are also employed for running the drill string into and out of the well and for otherwise performing drilling and pipe handling operations. Conventionally, the rotary table and the drawworks and the power units for driving and operating the same constitute massive, relatively, complicated and expensive structures, particularly those designed for deep drilling.

U.S. Pat. Nos. 3,722,603; 3,722,607 and 3,888,318 disclose fluid pressure operated snubber devices for use in drilling wells, which generally take the place of the rotary table and drawwork systems conventionally heretofore employed. The devices may comprise a stationary lower snubbing head and a rotatable and vertically reciprocable upper snubbing head for rotating drill pipe when drilling a well and for running the drill pipe into and out of the well. Other snubber devices are shown in U.S. Pat. Nos. 3,194,313 and 3,282,357.

Although other snubbing devices are known in the prior art, they are primarily for servicing operations, being used only to pull and rerun pipe in already completed wells. Such devices eliminate the need of killing the well and the cost, time and problems associated with circulating mud, salt water or other kill fluids. They also eliminate the danger of kill fluids causing permanent damage to the well bore and formation and the problem of loosing expensive kill fluids to the formation. However, such units have not heretofore been designed for, nor capable of, drilling.

One of the problems associated with snubbing devices suitable for drilling is the provision of a compatible swivel assembly which will not hinder the drilling operations. For example, the swivels of U.S. Pat. Nos. 3,194,313 and 3,282,357, disclose snubbing devices in which the swivel itself is used to deliver power for rotating the drill string. The swivel is threadedly engaged with the upper joint of the drill string. This arrangement calls for separate components for reciprocation of the drill string during running and pulling of the pipe and requires that the power swivel be removed during running in and pulling operations. Obviously, this increases operation time.

SUMMARY OF THE INVENTION

The present invention is directed to a well drilling unit or system utilizing a snubber device, such as is disclosed in the aforementioned U.S. Pat. No. 3,888,318, which is designed for both rotation and reciprocation of a drill string. The system disclosed includes a support frame or skid on which the snubber device is mounted, a small mast, at least one swivel assembly suspended by a cable from the mast for handling pipe joints to be added to or taken from the drill string, and a power winch connected to the cable for raising and lowering of the swivel assembly.

Since the hydraulic snubbing device generally takes the place of the conventional rotary table and drawwork system, the mast may be relatively simple and of low capacity. Its major function will be merely to support relatively low weight elements such as the swivel assembly and mud hoses and, at the most, only a few sections of pipe, since the main load of the pipe strings both in drilling and in running into and out of the well will be taken by the snubber heads.

A unique swivel assembly is disclosed which comprises an upper stationary section and a lower rotatable section adapted to receive one end of a pipe joint and having a radially movable latch assembly for engagement therewith. The lower rotatable section also carries a cam assembly movable from an inoperative position to an operative position by which the latch assembly is cammed from a first position, permitting free entry of the pipe joint end into the lower section, to a second position, latching the pipe joint end in the lower section. Such swivel apparatus may be operated manually or hydraulically as will be seen hereafter.

This unique swivel assembly is designed not to interfere with reciprocation and rotation of the drill string by the snubber during operations. In fact, it allows an additional joint of pipe to be added to the drill string while drilling operations are proceeding. By providing a pair of such swivel assemblies, a pipe joint can be attached to one of the swivel assemblies, picked up and made ready to add to the drill string while the other swivel assembly is attached to the last joint of the drill string, providing the necessary support and drilling mud communication therewith.

The drilling unit of the present invention is thus very compact, low in cost, easily transportable and simple to operate. Other and more specific objects and advantages of the invention will become readily apparent from the detailed description which follows when read in conjunction with the accompanying drawings.

BRIEF DESCRIPTION OF THE DRAWINGS

In the description which follows reference will be made to the accompanying drawings in which:

FIG. 1 is an elevation view of a well drilling unit, according to a preferred embodiment of the invention, utilizing a snubber device, special swivels and other specially designed apparatus;

FIG. 8 is a top plan view of the pulley and cable arrangement installed at the top of the mast of the drilling unit shown in FIG. 1;

FIG. 9 is a partial elevation view of the mast used in the drilling unit of the present invention, showing stand pipe on each side thereof;

FIG. 10, taken along line 10—10 of FIG. 3, is a cross-sectional view of the swivel of FIGS. 2 and 3, in the latched position;

FIG. 11 is a schematic view of the mast and snubber device of the present invention showing the mast in an upright position;

FIG. 12 is a schematic view similar to FIG. 11, but showing the mast in a lowered or traveling position;

FIG. 13, taken along line 13—13 of FIG. 1, is a top plan view of a portion of the drilling unit of FIG. 1;

FIG. 14, taken along line 14—14 of FIG. 1, is a partial elevation view of the mast and one of the swivels of the drilling unit shown in FIG. 1 to illustrate the position of the swivel, the stand pipe, and the lines for keeping the swivel from rotating;

DESCRIPTION OF PREFERRED EMBODIMENTS

Figure 2:
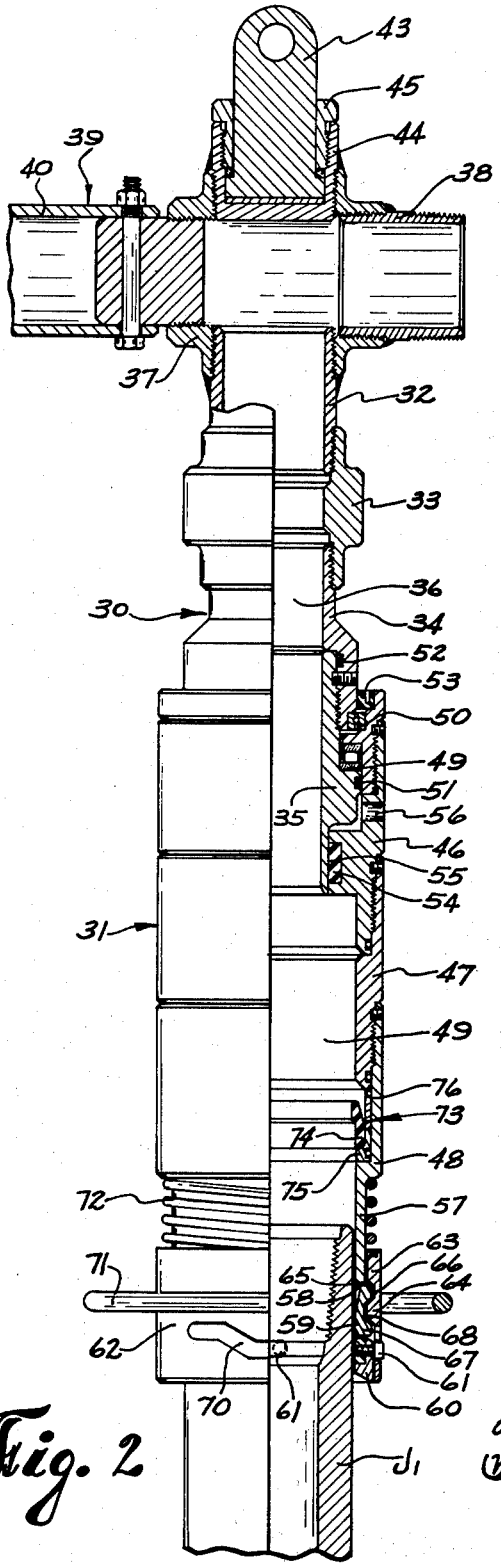
FIG. 2 is a longitudinal quarter-sectional view of one of the swivels of FIG. 1 in which the latch assembly is shown in a position permitting free entry of the end of a joint of pipe line into the lower section thereof.

Referring first to FIG. 1, there is shown a portable well drilling unit, according to a preferred embodiment of the invention. The unit may comprise a support frame or skid F on which the entire unit may be mounted. Attached to the support frame F for disposition directly above the well hole to be drilled is a hydraulic snubbing device D. A blowout preventer stack B and stripper R may also be attached to the frame directly above the well hole.

Immediately adjacent to the snubbing device D is a mast M, the purpose of which is to support various apparatus, to be described hereafter, for handling pipe joints being run into or taken out of the well hole. As best seen in FIGS. 11 and 12 the mast M may comprise a stationary lower section 1 to which an upper section 2 is pivotally attached so that the mast may be moved from the upright position of FIG. 11 to the horizontal position of FIG. 12. A structural member 3 may be utilized to provide support for the pivotal portion of the mast in the lowered or horizontal position. The lowered position, of course, allows the skid-mounted unit to be easily transported by truck, rail or whatever without serious overhead clearance problems. As best seen in FIG. 1, a hydraulic piston and cylinder assembly 4 may be provided for attachment at one end to the frame F and at the opposite end to mast M for raising and lowering the upper portion of the mast 2. The mast may be firmly maintained in the raised or upper position by a connection at 5. This connection may be released to permit the upper mast portion 2 to be lowered.

The mast M also includes a pulley assembly 6, similar to the crown block of a conventional derrick, but of much less weight and simpler construction. As seen in FIGS. 1, 8 and 13, the pulley assembly of the exemplary embodiment comprises a first pair of pulleys 7 and 8, a second pair of pulleys 9 and 10 and an intermediate third pair of pulleys 11 and 12 mounted for rotation on a mounting block 13. Structural bracing 14 is also provided. The primary purpose of the mast M and pulley assembly 6 is to support a pair of swivel members S-1 and S-2 for handling pipe joints $J_1$ and $J_2$ to be added to or taken from the drill string $D_s$. Cables 14 and 15 are attached to each swivel and run over a corresponding pair of pulleys 7, 8, 9 and 10 to corresponding power winches W-1 and W-2 about which the ends of the cables 14 and 15 are wound. A lifting plug P may also be suspended by cable 16 from the pulley assembly. The cable 16 may run over the intermediate pulleys 11 and 12 to a third power winch W-3.

Drilling fluids may be supplied to the swivels S-1 and S-2 through vertical stand pipes 17 and 18 and flexible mud lines 19 and 20. The stand pipes 17 and 18 may be supported alongside mast M by attachment to the mast with brackets 21 and 22.

The hydraulic snubbing device comprises a stationary lower head H-1 and an upper head H-2, which is both vertically reciprocal and rotatable relative to the lower head H-1. These snubbing heads cooperate with the drill string $D_s$ to perform the rotary drilling functions and the running of the pipe string into and out of the well. Each of the snubbing heads H-1 and H-2 includes sets of vertically reciprocal pipe gripping wedges or slips and angularly rockable, cam-actuated gripping shoes for applying torsional forces to the pipe string for use both in rotating the pipe string for drilling and when making and breaking the threaded pipe joints, as when adding joints to the drill string and when running the string into and out of the well. The snubbing device D generally takes the place of the rotary table and drawworks systems commonly employed on conventional drilling rigs. For purposes of the present disclosure, no further description of the snubbing device D is necessary. However, for the specific details of construction and operation of such a snubbing device reference may be made to the aforementioned U.S. Pat. No. 3,722,603.

As stated heretofore the purpose of the swivels S-1 and S-2 is to handle joints of pipe $J_1$ and $J_2$ being added to or taken from the drill string $D_s$. These swivels are unique in construction and will be described in detail with reference to FIGS. 2, 3, and 10. The swivel is generally made up of an upper stationary section 30 and a lower rotatable section 31. The upper stationary section 30 may comprise tubular components 32, 33, 34, and 35 for providing a flow passage 36 between a cross member 37 and the interior of rotable section 31. The cross member 37 is provided with a suitable connection such as nipple 38 for connection with a mud line or hose such as 19 in FIG. 1. Thus, drilling fluids may be passed from the mud hose through the cross member 37 and passageway 36 into the lower rotatable section 31. The opposite side of the cross member 37 may be provided with torque back-up apparatus which may compskwe an arm member 40, the purpose of which is to prevent rotation of the upper section 30 of the swivel. To accomplish this purpose, suitable support members 41 and a vertical cable 42 are attached to the mast M, as best shown in FIGS. 13 and 14. The end of arm 40 opposite its connection with swivel cross 37 is slidingly connected to the cable 42 permitting up and down movement of the swivel but preventing rotation of the upper section 30. This provides torque back-up during make-up and break-out of pipe joints from the drill string $D_s$, as well as during the drilling operations. A cable connector 43 is also attached to the cross member 37 and is the means by which a cable, such as 14 in FIG. 1, may be attached to the swivel for suspension from the mast M. The cable connector 43 may be retained in a plug member 44 by bushing 45.

The lower rotating section 31 of the swivel comprises tubular members 46, 47 and 48 through which a passageway 49 may communicate with the pipe joint $J_1$ which is to be handled by the swivel. A load carrying thrust bearing 49 and a radial bearing 50 are mounted between the upper tubular member 46 of rotatable section 31 and lower tubular members 34 and 35 of non-rotatable section 30. Protective seals 51, 52 and 53 are provided above and below the bearings 49 and 50. A rotating seal 54 may be carried by tubular member 46 for rotating sealing engagement with a suitable cylindrical sealing surface 55 on tubular member 35 of the non-rotating section 30. This seal 54 allows drilling fluid to be circulated through the swivel into the drill string when the pipe joint $J_1$ is properly connected, as will be discussed hereafter. A relief vent hole 56 may be provided in case drilling fluids leak past the seal 54.

The lower tubular member 48 may comprise a downwardly depending sleeve member 57 having radial apertures 58 therethrough in which are carried a plurality of latches 59. Affixed to the lower end of the sleeve 57 is a guide collar 60 and a plurality of guide pins or screws 61. Surrounding the sleeve portion 57 in a sliding telescopic fit is a cam sleeve 62. The interior of cam sleeve 62 comprises a pair of annular shoulders 63 and 64 between which lies an annular groove 65. The exterior of latches 59 are provided with corresponding annular shoulders 66 and 67 having an annular groove 68 therebetween. In the relaxed or inoperative position of FIG. 2, the lower shoulder 64 of the cam sleeve 62 is disposed between the shoulder 66 and 67 of latch 59, permitting the latch 59 to assume a retracted, or first position, permitting free entry of one end of the pipe joint $J_1$ into the rotatable section 31 of the swivel. The relative positions of cam sleeve 62 and latches 59 are maintained by the engagement of guide pins 61 with the lowermost horizontal portion of a cam slot 70 in cam sleeve 62.

Figure 3:
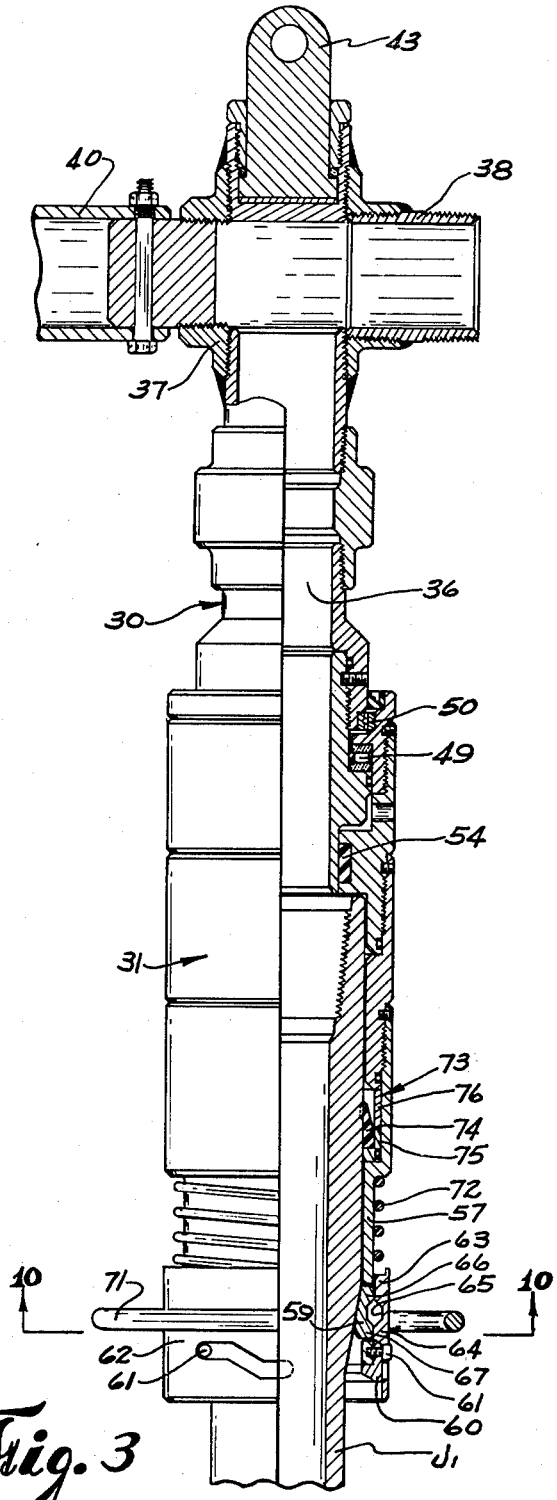
FIG. 3 is a longitudinal quarter-sectional view of the swivel of FIG. 2, showing the latch assembly in an operative position in which the joint of pipe is latched in the lower section.

Once the upper end of pipe joint $J_1$ is fully received within rotatable section 31, as shown in FIG. 3, the latches 59 may be moved to a second position, as in FIG. 3, engaging the pipe joint and preventing it from being displaced therefrom. This is accomplished by grasping a circular handle 71 attached to cam sleeve 62 and rotating the cam sleeve 62 thereby. Rotation of the sleeve 62 causes the cam slot 70 to follow guide pins 61 displacing the cam sleeve 62 in a downward axial direction until cam shoulder 63 and 64 register with cam shoulders 66 and 67 of latches 59. This cams the latches 59 inwardly for engagement with the upset portion of pipe joint $J_1$. A spring member 72 biases the cam sleeve 62 downwardly and assures that the latches 59 remain in the second or locked position of FIG. 3. The length of the bore or passageway 49 is designed to accommodate the upset portion of the pipe joint $J_1$ in such a way that the latches 59 engage the joint at the proper position for engagement therewith. The inner faces of latches 59 may be slightly tapered to correspond with the tapered portion of the pipe joint $J_1$.

A mud seal assembly 73 is provided within rotating section 31 so that a fluidtight seal may be established between the swivel and the pipe joint $J_1$ in the latched-in position of FIG. 3. The mud seal assembly may comprise a resilient annular lip type seal 74 bonded to a carrier ring 75 and maintained in a proper axial position by spacer ring 76.

Figure 15:
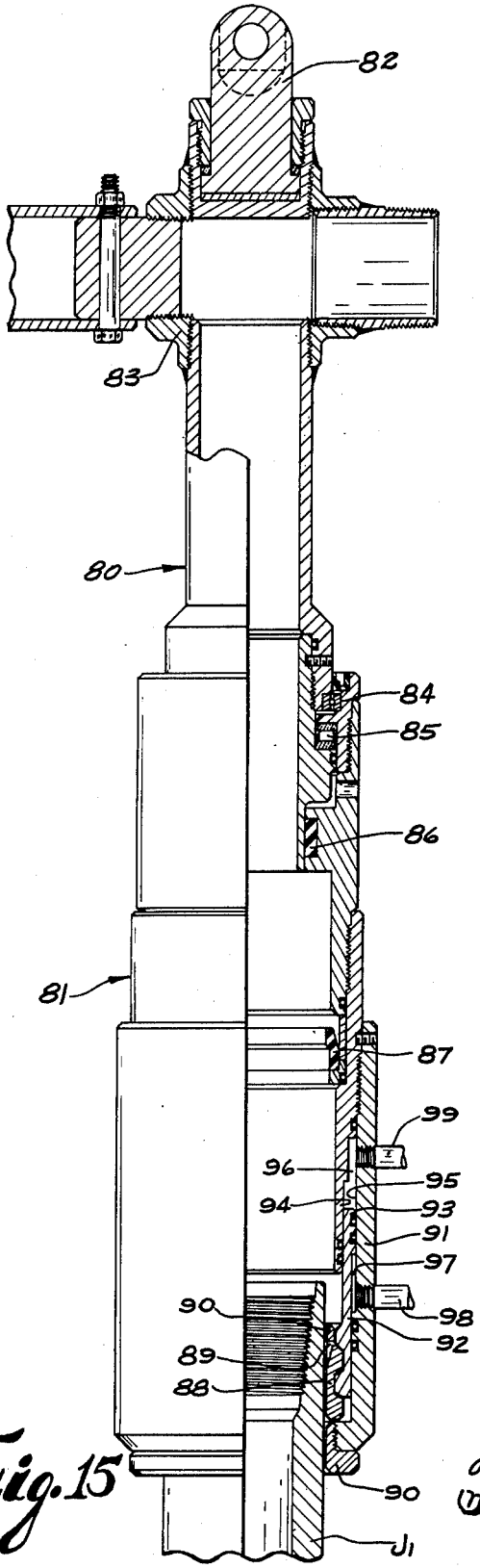
FIG. 15 is a longitudinal quarter-sectional view of a hydraulically operated embodiment of the swivel of the present invention, similar to the manually operated embodiment shown in FIGS. 2 and 3, shown in the unlatched position.
Figure 16:
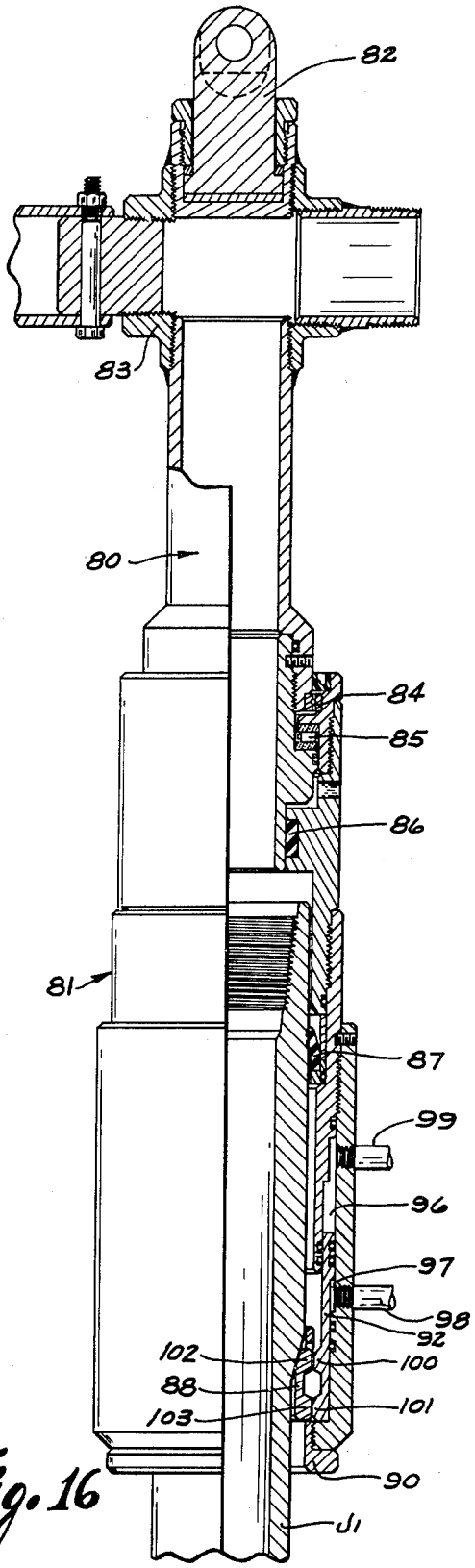
FIG. 16 is a longitudinal quarter-sectional view of a swivel according to the alternate embodiment of FIG. 15, shown in the latched position.
Figure 17:
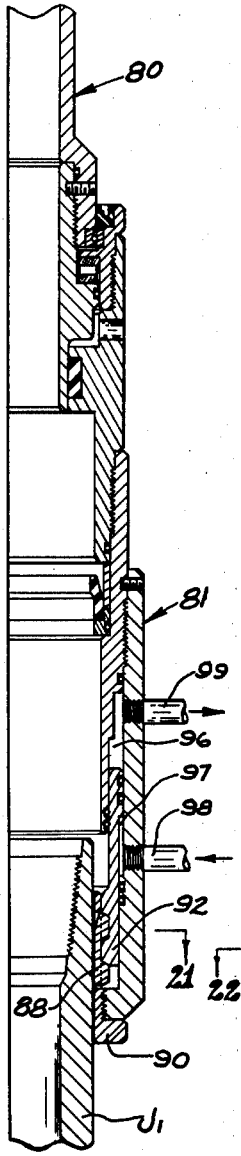
FIG. 17 and 18 are longitudinal quarter-sectional views of the swivel shown in FIGS. 15 and 16 illustrating the operation thereof.

The cam and latch mechanisms of the swivel apparatus of FIGS. 2, 3, and 10 are, as previously described, manually operated. However, such swivel apparatus may be adapted to hydraulic operation and reference is now made to FIGS. 15–22 which illustrate such variations. As seen in FIGS. 15 and 16, most of the components of the hydraulic version of the swivel are identical to the manual version just described. The hydraulic version contains an upper non-rotatable section 80 and a lower rotatable section 81 corresponding with said sections 30 and 31, respectively, in the manual version. Cable connector 82, cross member 83, radial bearing 84, thrust bearing 85, rotating seal 86 and mud seal 87 may be identical to corresponding components of the manual version.

Figure 18:
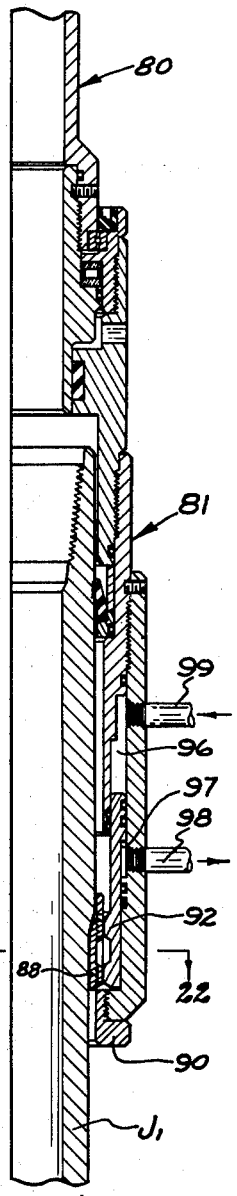
Figure 21:
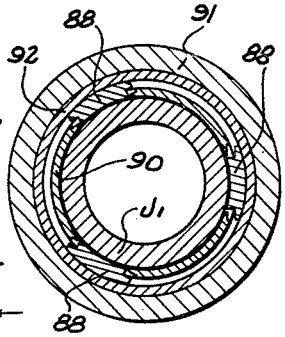
FIG. 21, taken along line 21—21 of FIG. 17, is a cross-sectional view of the swivel of FIG. 17 in the unlatched position.
Figure 22:
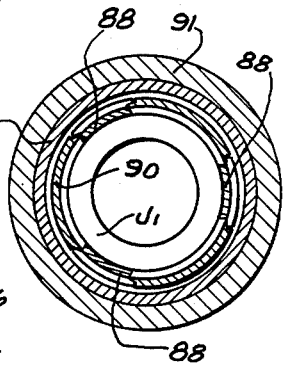
FIG. 22, taken along line 22—22 of FIG. 18, is a cross-sectional view of the swivel of FIG. 18 in the latched position.

The primary difference in the hydraulic version lies in the latch and cam assemblies. As in the previous version a plurality of radially movable latches 88 are provided. However, these latches 88 are mounted in a slightly different manner. They are carried in radial apertures 89 of an upwardly projecting sleeve 90 which is attached to a surrounding cylindrical housing 91. This version also includes an axially movable cam sleeve 92 as in the manual version. However, the sleeve 92 is provided with an annular piston portion 93 for engagement with inner and outer cylindrical surfaces 94 and 95 forming upper and lower variable pressure chambers 96 and 97. When pressure is applied to lower pressure chamber 97 through an appropriate conduit 98 the latch sleeve 92 is displaced upwardly to the inoperative or joint receiving position of FIG. 15. Once the pipe joint $J_1$ is fully received by the lower rotatable section 81 the latch 88 may be moved to the second or engaging position of FIG. 16 by applying pressure to the upper chamber 96 through conduit 99, causing the cam sleeve 92 to move downwardly, camming the latches 88 to the inner position by the engagement of cam shoulders 100 and 101 with latch shoulders 102 and 103. These operations are further illustrated by FIGS. 17 and 18, FIG. 17 being the relaxed or pipe receiving position and FIG. 18 being the pipe engaging position in which the pipe joint $J_1$ is locked within the swivel. As illustrated by the arrows, pressure is applied to lower chamber 97 through conduit 98 while pressure is relieved from upper chamber 96 through conduit 99 to maintain the cam sleeve 92 and consequently, latches 88 in a pipe receiving position. The pressures are reversed, as shown in FIG. 18, to move the cam sleeve 92 to an operative position for camming latches 88 into engagement with pipe joint $J_1$. Thus, pressure is relieved from lower chamber 97 through conduit 98. FIGS. 21 and 22 illustrate the position of latches 88 in the retracted or first position and engaging or second position, respectively.

Figure 19:
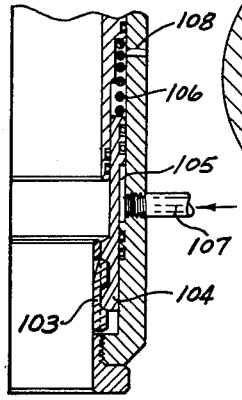
FIGS. 19 and 20 are quarter-sectional views of still another hydraulically operated embodiment of a swivel of the invention.
Figure 20:
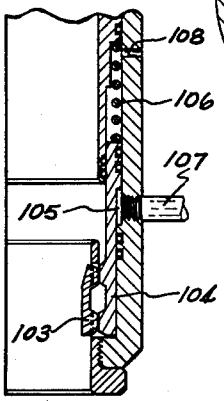

FIGS. 19 and 20 illustrate another variation of the hydraulic version of the swivel apparatus. Latches 103 and cam sleeve 104 are substantially identical to latches 88 and sleeve 92 in the previously discussed hydraulic version. However, in the alternate embodiment only one pressure chamber 105 is provided, the function of the other pressure chamber being replaced by a spring member 106 which biases the latching sleeve 104 in a downwardly direction. To maintain the cam sleeve 104 and latches 103 in the pipe receiving position of FIG. 19 pressure is applied to chamber 105 through conduit 107 causing the cam sleeve 104 to assume the upwardly displaced position therein. After the pipe joint is fully received within this version of the swivel, pressure may be relieved from chamber 105 through conduit 107 allowing the spring biasing force of spring 106 to force the cam sleeve 104 in a downwardly direction and camming latches 103 into the second or pipe latching position of FIG. 20. A vent hole 108 may be provided to prevent back pressure against cam sleeve 104 when it is displaced upwardly.

In summary, operation of the snubber device D of the drilling unit rotates and gradually feeds the drill string $D_s$ (see FIG. 1) in a downwardly direction as hole is made. The snubbing device periodically extends itself, as described in the aforementioned U.S. Pat. No. 3,722,603, taking a new bite or grip on the drill string $D_s$. From time to time it is necessary to add joints of pipe to the drill string. Such a joint of pipe $J_1$ may be latched into and suspended by a swivel S-1 directly over the drill string $D_s$, as shown in FIG. 1. The joint $J_1$ is then stabbed into the upper end of drill string $D_s$ and made up by the proper rotation of snubber head H-2. Then drilling resumes with the upper end of pipe joint $J_1$ still being supported by swivel S-1. Tension may be maintained on the cable 14 to prevent the pipe joint $J_1$ from whipping along its unsupported length. During drilling operations the torque arm 40 prevents rotation of the upper section of the swivel S-1 while the lower section rotates. As previously described, the swivel S-1 is equipped with a rotating seal which will allow drilling fluids to be circulated from stand pipe 17 and mud hose 19 through swivel S-1 into the drill string $D_s$.

While drilling operations proceed, another joint of pipe $J_2$ is latched onto with the second swivel S-2 and placed in a substantially vertical position ready for attachment to the drill string $D_s$. When the drill string $D_s$ has advanced a sufficient amount, swivel S-1 is released from the upper pipe joint $J_1$ and the standby pipe joint $J_2$ is placed in position by swivel S-2 for making up with the drill string $D_s$. Then the swivel S-1 is free for attachment to another pipe joint. This operation is repeated until the hole is completed.

Swivels S-1 and S-2 may also be used fKsimply pulling and running pipe and this may be done without stroking the traveling snubber head H-2 once the pipe string weight becomes less than the capacity of mast M. However, since the swivels S-1 and S-2 are designed to permit circulation of drilling fluids, certain components therein are not necessary for merely running and pulling pipe. Thus, pulling apparatus may be designed similarly to swivels S-1 and S-2 but without the unnecessary components thereof. Such a pulling plug P is depicted in FIG. 1 as being suspended from the mast M by cable 16 and pulleys 11 and 12. The cable is attached to winch W-3 for control thereof. As shown in FIG. 1, a receptacle $P_r$ may be provided for retaining the pulling plug P when not in use.

Figure 4:
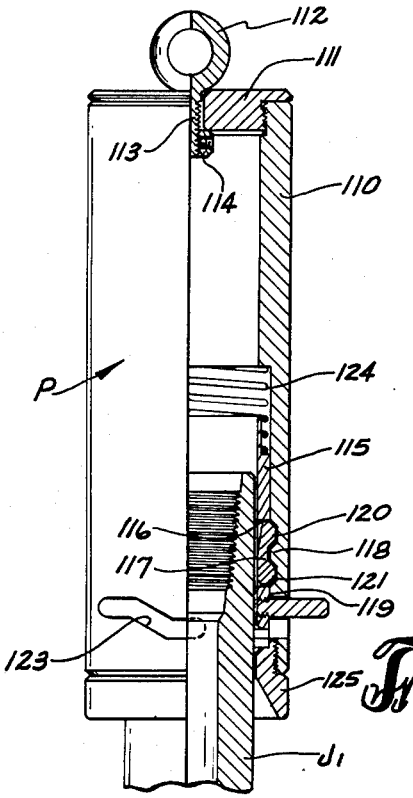
FIG. 4 is a longitudinal quarter-sectional view of a lift plug, according to a preferred embodiment of the invention, showing a joint of pipe being received therein.
Figure 5:
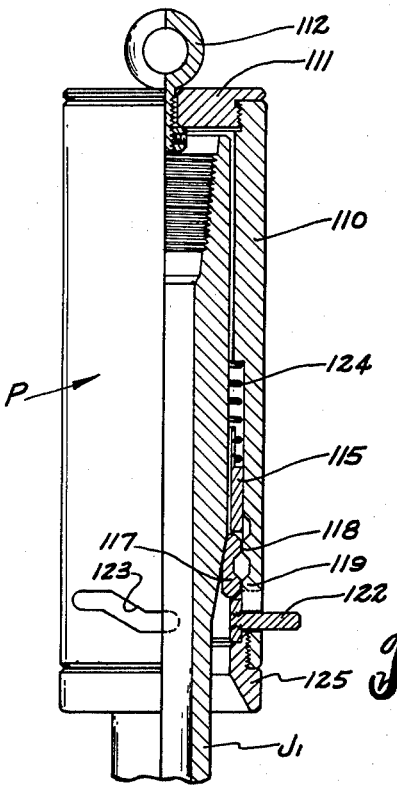
FIG. 5 is a longitudinal quarter-sectional view of the lift plug of FIG. 4, showing the pipe joint received therein fully latched into the bore of the tool.

Referring now to FIGS. 4 and 5, the pulling plug P will be described in more detail. The plug P may comprise a tubular housing 110 at the upper end of which is a coverplate 111 and a cable connector ring 112. The ring 112 may have a threaded extension 113 thereon for insertion through a hole in coverplate 111 and for receiving a nut 114 by which the ring 112 is held thereto. Like the manual version of the swivel described herein, the pulling plug P may be provided with a cylindrical sleeve member 115 having apertures 116 for carrying a plurality of radially movable latch members 117. The interior of tubular housing 110 is provided with cam shoulders 118 and 119 which, in the inoperative or pipe receiving position of FIG. 4, lie immediately adjacent a corresponding pair of shoulders 120 and 121 on latch 117. In this retracted or inoperative position the end of a pipe joint $J_1$ may be received within the pipe plug P. The upper movement of the pipe joint $J_1$, relative to pipe plug P, will be arrested by the upper plate 111, as best seen in FIG. 5.

Attached to the lower end of latch sleeve 115 is a handle member 122 which projects outwardly through a cam slot 123 in tubular housing 110. Once the end of pipe joint $J_1$ has been fully received within pulling plug P, the handle 122 may be rotated along cam slot 123, finally assuming a downwardly displaced axial position. The downward movement of sleeve 115 causes the latches 117 to move downwardly and to be cammed inwardly, to the second position of FIG. 5, engaging the tapered area of the upset tubing and locking the pipe joint $J_1$ in the plug P. Spryng 124 biases the sleeve 115 and latches 117 towards such a locked position and assures that this position is maintained. Since a tool such as plug P is designed for running and pulling use only, no mud seals nor mud line connections are required. Thus, it is much easier to operate and would preferably be used in such cases.

Figure 6:
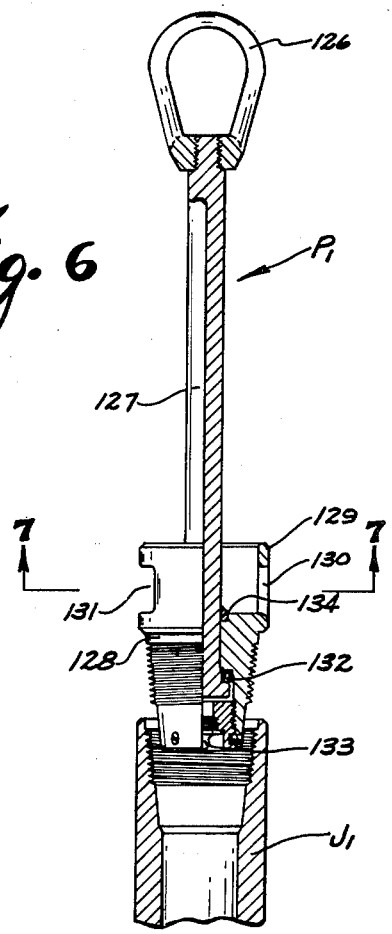
FIG. 6 is a longitudinal quarter-sectional view of an alternate embodiment of a lift plug, suitable for use with the present invention.
Figure 7:
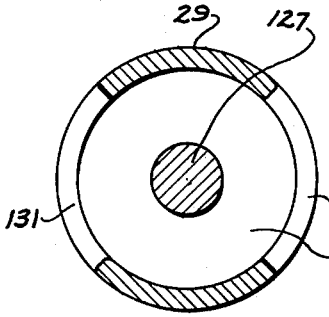
FIG. 7, taken along line 7—7 of FIG. 6, is a cross-sectional view of the lift plug of FIG. 6.

An alternate pulling plug design is shown in FIGS. 6 and 7. Such a plug $P_1$ includes a cable connector ring 126 and rod 127. An externally threaded connection plug 128 is rotatingly mounted on the lower end of rod 127, permitting the plug 128 to be rotated and threadingly made up with a pipe joint $J_1$. The upper portion of the threaded plug 128 may be provided with an inverted skirt 129 having holes 130 and 131 for gripping by the hand. Thus, the plug 128 may be rotated by hand for making up with the pipe joint $J_1$. A bearing 132 may be provided between the lower end of rod 127 and plug 128 to reduce rotating friction. A grease fitting 133 may be provided so that the bearing and the rotating connection may be lubricated. A seal 134 prevents loss of lubrication fluids.

It can be seen from the foregoing discussion that the drilling unit of the present invention provides a highly portable, low cost, easily operated drilling system. The unit is exceptionally light and can be broken down into easily transportable sections. Because it is hydraulically powered, the unit does not have to be installed with support equipment in specific relative positions. For example, on offshore locations, auxiliary equipment such as the prime mover, mud system and pipe racks can be installed on a nearby barge or workboat, as long as the unit pipe hoisting system can conveniently reach racked tubular goods. Many of the components of the system are unique in themselves. In addition to the snubber device, the special swivel assemblies and pulling plug offer many advantages not possible in the prior art.

Although several variations of the invention have been discussed herein, there are many others which may be made without departing from the spirit of the invention. It is therefore intended that the scope of the invention be limited only by the claims which follow.

I claim:

1. Swivel apparatus for use with well drilling systems comprising:

(a) an upper stationary section;

(b) a lower rotatable tubular section adapted to receive one end of a pipe joint and having radially movable latch means therein for engagement with said pipe joint end;

(c) means for supporting said upper and lower sections for limited vertical movement above a well hole;

(d) said lower section including cam means longitudinally movable, relative to said latch means, from an inoperative position to an operative position camming said latch means from a first position, permitting free entry of said pipe joint end into said lower section, to a second position latching said pipe joint end in said lower section, said latch means being carried on a first tubular sleeve, said cam means being carried on a second tubular sleeve, and said tubular sleeves being axially movable relative to each other to effect said camming of said latch means into said second position;

(e) means operatively associated with said cam means for selectively retaining said cam means in said inoperative position independently of said pipe joint end comprising interengaged formations projecting as to one of said sleeves and receiving as to the other for preventing non-rotative relative longitudinal movement but permitting relative rotation of said sleeves from said inoperative position; and (f) biasing means carried by said lower section biasing said camming means toward said operative position.

2. Swivel apparatus as set forth in claim 1 comprising annular seal means on the interior of said lower tubular section engageable with the exterior of said pipe joint end providing a fluidtight seal between said pipe joint and said swivel apparatus.

3. Swivel apparatus as set forth in claim 1 wherein said latch means are substantially longitudinally fixed with respect to said lower section.

4. Swivel apparatus as set forth in claim 1 in which one of said sleeves is provided with handle means by which said sleeve may be axially displaced to effect said camming of said latch means into said second position.

5. Swivel apparatus as set forth in claim 1 in which said upper section has a passageway therethrough, providing communication between the interior of said tubular lower section and the exterior of said upper section, by which drilling fluids may flow to said pipe joint.

6. Swivel apparatus as set forth in claim 5 comprising annular seal means carried by said lower section engageable with said one end of a pipe joint to provide a fluidtight seal between said pipe joint and said swivel apparatus.

7. Swivel apparatus as set forth in claim 5 comprising bearing means between said upper and lower sections to allow relatively frictionless rotation between said upper and lower sections.

8. Swivel apparatus as set forth in claim 7 comprising annular seal means between said upper and lower sections providing a rotating fluidtight seal therebetween.

9. Swivel apparatus as set forth in claim 5 comprising first annular seal means carried by said lower section engageable with said one end of a pipe joint, providing a fluidtight seal between said pipe joint and said swivel apparatus, and second annular seal means carried between said upper and lower sections, providing a fluidtight seal therebetween.

10. Swivel apparatus as set forth in claim 1 comprising a pair of swivel assemblies, each of which includes one of said upper stationary and lower rotatable sections, each of said swivel assemblies being independently operable so that while one swivel assembly supports a pipe joint above said well hole the other may be engaged with another pipe joint for subsequent support above said well hole.

11. Swivel apparatus as set forth in claim 10 in which each of said swivel assemblies is attached to a common source of drilling mud.

* * * * *

UNITED STATES PATENT AND TRADEMARK OFFICE

CERTIFICATE OF CORRECTION

PATENT NO. : 4,226,447

DATED : October 7, 1980

INVENTOR(S) : Cicero C. Brown, deceased, late of Houston, Tex. by Joe Brown, Executor It is certified that error appears in the above-identified patent and that said Letters Patent are hereby corrected as shown below:

In Column 5, line 1, after "may" delete "compskwe" and insert therefor --comprise--.

In Column 7, line 56, after "used" delete "fKsimply" and insert therefor --for simply--.

In Column 8, line 33, after "P." delete "Spryng" and insert therefor --Spring--.

Signed and Sealed this

*Twenty-seventh* Day of *January 1981*

[SEAL]

*Attest:*

RENE D. TEGTMEYER

*Attesting Officer*

*Acting Commissioner of Patents and Trademarks*